United States Patent [19]

Dietz

[11] 4,433,219

[45] Feb. 21, 1984

[54] DIFFERENTIAL PRESSURE SWITCH WITH SQUARE DIAPHRAGM PLATE SUPPORTED BY THE DIAPHRAGM

[76] Inventor: Henry G. Dietz, 80 Salisbury Ave., Garden City, N.Y. 11530

[21] Appl. No.: 350,820

[22] Filed: Feb. 22, 1982

[51] Int. Cl.[3] ..... H01H 35/34

[52] U.S. Cl. ..... 200/83 R; 200/83 A; 200/83 Y; 200/83 W

[58] Field of Search ..... 200/83 R, 83 N, 83 S, 200/83 WM, 83 W, 83 SA, 83 A, 83 Y

[56] References Cited

U.S. PATENT DOCUMENTS 3,407,277 10/1968 Chapin ..... 200/83 WM
3,852,547 12/1974 Dietz ..... 200/83 A X
3,911,393 10/1975 Biggs ..... 200/83 N X
4,085,305 4/1978 Dietz ..... 200/83 A
4,104,495 8/1978 Jones et al. ..... 200/83 S X

*Primary Examiner*—J. R. Scott

[57] ABSTRACT

A miniaturized differential pressure switch comprising a pair of matched square housing sections with a square diaphragm supporting a flat square diaphragm plate which bears against a compression spring that is flexed to open an electrical contact in dependence upon the pressure differential. The compression spring is removably mounted for exchange of springs to vary the range of operation of the switch. The housing section that defines the low pressure chamber provides means for mounting a heat sink that is used for the support of components required for an electronic relay. The switch is suitable for actuation by extreme low pressure, such as 0.01 inch water column.

3 Claims, 5 Drawing Figures

DIFFERENTIAL PRESSURE SWITCH WITH SQUARE DIAPHRAGM PLATE SUPPORTED BY THE DIAPHRAGM

SUMMARY OF THE INVENTION

This invention relates to a miniaturized differential pressure switch, and more particularly, to a pressure switch of small proportions that can be actuated by as little as 0.01 inch of water column of differential pressure.

Differential pressure switches are known. Generally these switches are not capable of being actuated by extremely low pressure. The present state of the art is such that switches that commonly operate on 0.01 inch of water column can be extremely large, since the pressure necessary to actuate the electrical contacts can only be obtained by increasing the number of square inches of the diaphragm area to obtain the necessary pressure to operate the contacts. In miniaturized switches near the size of my invention, the lowest pressure normally obtainable is 0.5 inches of water column.

A principal object of my invention is to provide a miniaturized differential pressure switch that will provide reliable operation on an actuating pressure of 0.01 inch of water column.

Another principal object of the invention is to provide a super-sensitive differential pressure switch that is reduced to a minimum of separate parts and simplified construction by having the square diaphragm plate supported by the diaphragm.

Another principal object of my invention is to provide a construction that allows the miniaturized differential pressure switch to take large pressure overloads without damage.

Another principal object of my invention is to provide the smallest possible size switch by using the most efficient configuration, which is a square diaphragm. The majority of switches use circular diaphragms that greatly reduce the area available for actuation of the electrical contacts.

Another principal object of my invention is to provide that a single set of solid precious metal contacts of reduced size be used to keep cost at a minimum.

Another principal object of my invention is to provide means for mounting a heat sink that also provides support and mounting for all necessary parts for an electronic relay that is used to increase the allowable current and voltage ratings of the switch and allows the normally closed electrical contacts of the switch to have a configuration that simulates either a normally open or normally closed circuit.

Another principal object of my invention is to provide a means of connecting the electrical contacts to terminations located on the outside of the switch while providing a positive seal to prevent loss of the actuating pressure and eliminating the use of friction-creating connections.

Still another object of the present invention is to provide a differential pressure switch which can be used to actuate on pressure or vacuum differential pressures. It may be used to indicate static pressure or vacuum. When used as a differential switch, it can be activated by the velocity pressure of an air flow.

Other objects, uses, and advantages will be obvious or become apparent from a consideration of the following detailed description and the application drawings.

However, it is to be distinctly understood that the specific drawing illustrations provided are supplied primarily to comply with the requirements of the Patent Laws, and that the invention may have other embodiments that will be obvious to those skilled in the art, and which are intended to be covered by the appended claims.

DESCRIPTION OF THE PREFERRED EMBODIMENTS

Figure 1:
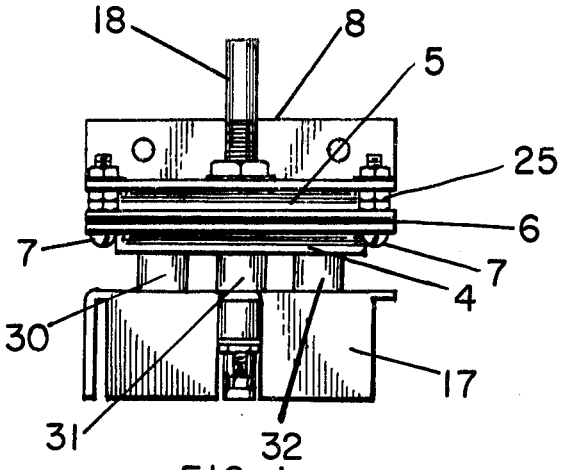
FIG. 1 is a top elevation view of a switch according to the invention.
Figure 2:
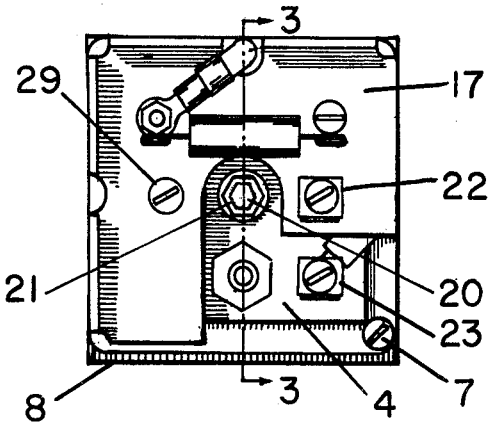
FIG. 2 is a front elevation view.

FIGS. 1 and 2 generally indicates a preferred embodiment of the invention which comprises a low pressure housing 4, and a high pressure housing 5, a diaphragm 6, made of silk cloth silicone coated or other suitable material, a diaphragm plate 9, a compression spring 12, an adjustment screw 20 threadedly mounted in the housing 4 in operative association with the spring 12 and the diaphragm plate 9, and a pair of electrical contacts 15 and 16 to be opened by the diaphragm plate 9 at the desired pressure differential. Contacts 15 and 16 are respectively connected to the respective electrical connectors 22 and 23.

The housing sections 4 and 5 are in face to face relation and made of plastic, and the sections 4 and 5 and the diaphragm 6 are of matching square configuration so that these parts may be assembled together by aligning their respective corners to receive suitable screws 7 and nuts 25 or suitable tubular rivets instead.

The housing sections 4 and 5 are formed with respective square recesses that are of limited depth, so that they define a diaphragm chamber across which is applied the diaphragm 6, that has its margin disposed between the rim portions of the respective housing sections 4 and 5.

The housing sections 4 and 5 are formed with an upstanding sealing ridge 33 (see FIG. 3) that is in unbroken circumambient relation about the recess in housing sections 4 and 5 to effect a good fluid tight seal about the diaphragm when the housing sections are clamped together under the action of tightening screws 7 and nuts 25.

The diaphragm 6 defines the housing sections 4 and 5 into a low pressure chamber 26 and a high pressure chamber 27. Housing section 4 has a threaded bore 34 communicating with the low pressure chamber 26 to a threaded tube 19 which allows low pressure or vacuum pressure to be applied to the switch by applying a suitable flexible tube over the projecting end portion of the tubular portion. Likewise, the threaded bore in housing section 5 allows high pressure to be applied to the switch by applying a suitable flexible tube over the threaded tubing 18.

Received within the low pressure chamber 26 is diaphragm plate 9. Plate 9 is square and made of polycarbonate with glass fibers or other suitable plastic having equivalent characteristics. Plate 9 is formed with a projecting boss 11 to accept the compression spring 12 and four projecting stops 10 to limit the movement of the diaphragm 6.

The diaphragm plate 9 is provided with projecting formed plastic rivets 13 that pass through the diaphragm 6 and the electrical connection 14 and the electrical contact 15. The application of heat to the plastic rivets 13 forms a head that fastens the diaphragm 6, the electrical connection 13, and the electrical contact 15 to the square plate 9. To provide for more secure fastening of the diaphragm 6 to the plate 9 additional rivets 13 are provided for a two hole washer 36 to aid in clamping the diaphragm 6 to the plate 9.

In accordance with this invention, the diaphragm plate 9 is operably associated with the compression spring 12 which is operably associated with the adjustment screw 20. Spring 12 is permanently fastened to the adjustment screw 20 by means of solder. The adjustment screw 20 is threadedly mounted in the housing 4. To prevent accidental movement of the adjustment screw 20 it is provided with a locknut 21. This adjustment screw 20 has a special significance in that when it is removed the compression spring 12 will pass without interference through the threaded bore of housing 4 making it possible to interchange compression springs to obtain various ranges of pressure actuation.

The invention provides for the contacts 15 and 16 to be normally closed when no pressure is applied to the pressure connection 18. When pressure is applied to the pressure connection 18, pressure is applied to the diaphragm 6, which in operative association with the diaphragm plate 9, opens the contacts 15 and 16 when the applied pressure overcomes the preadjusted force of the compression spring 12 for the desired actuating pressure.

Figure 3:
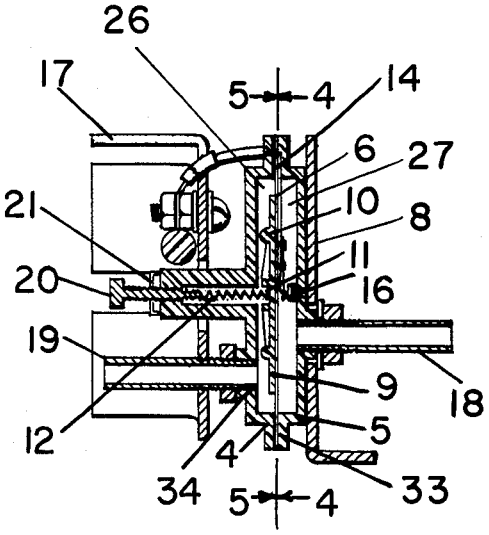
FIG. 3 is a sectional view taken substantially along line 3—3 of FIG. 2.
Figure 4:
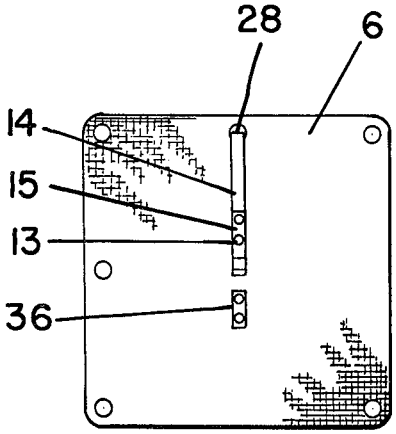
FIG. 4 is a sectional view taken substantially along line 4—4 of FIG. 3.
Figure 5:
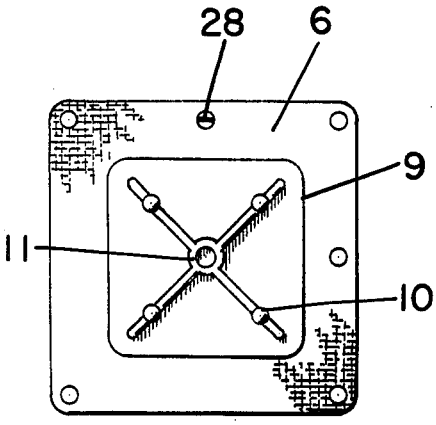
FIG. 5 is the sectional view taken substantially along line 5—5 of FIG. 3.

As indicated in FIG. 3, the electrical connection 14 passes through an opening 28 in the diaphragm 6, and then through an opening 29 in housing section 4. Electrical connection 15 may be connected directly to terminal 22 or fastened to the heat sink 17 which is made of conducting metal and fastened to terminal 22.

In like manner, an electrical connection is made from contact 16 to terminal 23.

If necessary, the switch can be supplied with a strengthening metal plate 8 that also provides means for mounting the switch.

The terminals 22 and 23, as well as the mounting screw 29, are screwed into metal inserts set into the plastic projections 30, 31, and 32 of the housing section 4. Housing sections 4 and 5 are injection molded of a glass filled polycarbonate plastic that is a non conductor of electricity. Other suitable plastics of equivalent characteristics may be substituted.

The switch can be used as a normally closed switch without the heat sink 17, if the electrical contacts 15 and 16 are used in a circuit where the current and voltage ratings are low in value and do not exceed the electrical ratings of the precious metal alloy contacts 15 and 16.

The switch provides for mounting of components on heat sink 17, so that an electronic relay may be installed to provide a normally open or normally closed equivalent circuit for using the switch at higher current and voltage ratings than possible with the simple touch contact 15 and 16.

The electronic circuit for the electronic relay consisting of a single resistor and a triac is not described with this invention as it is well known to those skilled in the art of electronics. Since no claim is made in this invention for this circuit, the actual wiring diagram is not shown.

However, the foregoing explanation does not limit the claim to be made that the switch provides for a heat sink 17 which allows an electronic relay to be mounted thereupon and simplifies the construction and installation of the switch.

The differential pressures sensed may be between two positive pressures, two negative pressures, a positive pressure and atmospheric pressure, and atmospheric pressure and a negative pressure, depending on the application. The pressure source connected to pressure connection 18 should be the higher of the differential pressures to be sensed.

The invention without the heat sink 17 and associated electronic relay can be used with low current electronic circuitry in applications such as sensing inhalation in animals and human beings, for sensing the need to defrost refrigeration by sensing the lack of air flow through refrigeration coils that have become frosted, detecting the loss of cooling air in electronic equipment due to blower failure, dirty air filters, or blockage of air passages, etc.

The invention with the heat sink 17 and appropriate electronic relay can be used in high current and high voltage applications having alternating current available.

However, the general arrangement involved may be readily adjusted for other applications, and specifics such as 0.01 inches of water column actuation pressure may be made more sensitive by simply increasing the size of the switch.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A differential switch comprising:

a housing including a pair of housing sections clamped together and formed to define between them an essentially square diaphragm chamber of restricted depth, an essentially square diaphragm of compliant material clamped between said housing section in fluid tight seal relation about said chamber, an essentially square diaphragm plate anchored to one side of said essentially square diaphragm and in juxtaposition thereto, an essentially square diaphragm plate formed with projections to limit movement of said diaphragm plate with respect to said housing, said essentially square diaphragm plate formed with a recessed boss to accept a compression spring, said compression spring is connected to an adjustment screw threadedly mounted in said housing, said adjustment screw is locked exteriorly of said housing with a torque nut, said essentially square diaphragm plate has formed projecting rivets for anchoring said essentially square diaphragm, electrical connection, and electrical contact in juxtaposition thereto, said electrical contact is normally in contact with an adjacent said electrical contact anchored to the housing, said electrical contact is provided with means for connecting to a terminal on abutments of said housing, said adjacent electrical contact is provided with means for connecting to an adjacent terminal on abutments of said housing, said housing sections have means for connecting the portions of said chamber on either side of said diaphragm to differential gas pressure sources, said spring being proportioned to normally hold said electrical contact in engagement with said adjacent electrical contact in one position of said spring, whereby, as pressure differentials on either side of said diaphragm increase, the spring changes and said electrical contact becomes disengaged from the said adjacent electrical contact.

2. The fluidic switch set forth in claim 1 wherein said housing is secured to a mounting plate, said mounting plate is anchored in juxtaposition to the said housing in communication with the high pressure side of the switch.

3. The fluidic switch set forth in claim 1 wherein said housing in communication with the low pressure side of the switch is secured in a heat sink, said heat sink is anchored to abutments on said housing to provide means for mounting the components parts for an electronic relay.

* * * * *